US010719036B2

(12) United States Patent
Tanaka

(10) Patent No.: US 10,719,036 B2
(45) Date of Patent: Jul. 21, 2020

(54) IMAGE FORMING APPARATUS

(71) Applicant: CANON KABUSHIKI KAISHA, Tokyo (JP)

(72) Inventor: Shoji Tanaka, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/358,905

(22) Filed: Mar. 20, 2019

(65) Prior Publication Data

US 2019/0219952 A1 Jul. 18, 2019

Related U.S. Application Data

(63) Continuation of application No. PCT/JP2017/036051, filed on Sep. 27, 2017.

(30) Foreign Application Priority Data

Sep. 30, 2016 (JP) ..... 2016-194938

(51) Int. Cl.
*G03G 15/10* (2006.01)

(52) U.S. Cl.
CPC ..... *G03G 15/105* (2013.01); *G03G 15/10* (2013.01)

(58) Field of Classification Search
CPC ..... G03G 14/10; G03G 15/105
See application file for complete search history.

(56) References Cited

U.S. PATENT DOCUMENTS 6,480,683 B2 11/2002 Hagiwara
8,509,638 B2 8/2013 Zollner
9,274,455 B2 3/2016 Miura et al.
9,389,541 B1 7/2016 Yatsuda et al.
10,139,756 B2 11/2018 Tanaka
2008/0317490 A1 12/2008 Yogome
2009/0035023 A1 2/2009 Thompson et al.
2012/0121282 A1* 5/2012 Oba ..... G03G 15/105 399/57

(Continued)

FOREIGN PATENT DOCUMENTS

EP 2 541 336 A1 1/2013
JP H11-272083 A 10/1999
JP 2001-201943 A 7/2001

(Continued)

OTHER PUBLICATIONS

PCT International Search Report and Written Opinion dated Dec. 26, 2017, in PCT/JP2017/036051.

(Continued)

*Primary Examiner* — Lamson D Nguyen
(74) *Attorney, Agent, or Firm* — Venable LLP

(57) ABSTRACT

In a case that a toner concentration of a liquid developer in a mixer is high and a liquid amount is small, when a supply flow rate of a carrier liquid by a carrier supplying pump is set, a "carrier amount for concentration adjustment" is preferentially assigned. Then, a remaining one is assigned to a "carrier amount for liquid amount adjustment". By doing so, by a non-interacting function, a supply agent can be supplied to the mixer. That is, the carrier liquid can be supplied by decreasing the supply agent so that a liquid amount can be easily satisfied while improving followability of a toner concentration.

12 Claims, 10 Drawing Sheets

(56) References Cited

U.S. PATENT DOCUMENTS

| | | | | |
|---|---|---|---|---|
| 2018/0253034 | A1* | 9/2018 | Doshida | G03G 15/105 |
| 2019/0294075 | A1* | 9/2019 | Kojima | G03G 15/10 |

FOREIGN PATENT DOCUMENTS

| | | | |
|---|---|---|---|
| JP | 2011-242777 | A | 12/2011 |
| JP | 5389252 | B2 | 1/2014 |
| JP | 2015-118175 | A | 6/2015 |
| WO | 2011/105159 | A1 | 9/2011 |

OTHER PUBLICATIONS

Korean Office Action dated Apr. 2, 2020, in related Korean Patent Application No. 10-2019-7011479.
European Search Report dated May 13, 2020, in related European Patent Application No. 17856519.8.

* cited by examiner

IMAGE FORMING APPARATUS

This application is a continuation of PCT Application No. PCT/JP2017/036051, filed on Sep. 27, 2017.

TECHNICAL FIELD

The present invention relates to an electrophotographic image forming apparatus for forming an image with a liquid developer.

BACKGROUND ART

Conventionally, the image forming apparatus for forming the image with the liquid developer containing toner and a carrier liquid has been proposed. In the image forming apparatus, the liquid developer accommodated in a mixer is supplied to a developing device and is subjected to development (Japanese Laid-Open Patent Application 2001-201943). A toner concentration of the liquid developer in the mixer is adjusted on the basis of a detection result of a concentration sensor and a liquid amount of the liquid developer in the mixer is adjusted on the basis of a detection result of a liquid amount sensor, respectively. The toner or a high-concentration liquid developer (these are referred to as a supply agent) is supplied from a toner tank to the mixer in the case where the toner concentration of the liquid developer is lower than a predetermined target value. On the other hand, the carrier liquid is supplied from a carrier tank to the mixer in the case where the liquid amount of the liquid developer is less than a lower limit or in the case where the toner concentration of the liquid developer is higher than the predetermined target value. The supply agent and the carrier liquid which were supplied to the mixer are mixed with an already-existing liquid developer by the mixer.

Incidentally, in the case where the liquid amount of the liquid developer is less than the predetermined lower limit, when the carrier liquid is only supplied, the toner concentration after supply of the carrier liquid lowers. Therefore, simultaneously with the supply of the carrier liquid for liquid amount adjustment, the supply agent in an amount depending on a supply amount of the carrier liquid is automatically supplied so that the toner concentration is unchanged before and after the supply of the carrier liquid (this is referred to as a non-interacting function). The supply amounts of such supply agent and carrier liquid are controlled by changing operation times of a pump for supplying the supply agent from the toner tank to the mixer and a pump for supplying the carrier liquid from the carrier tank to the mixer.

Problem to be Solved by the Invention

Incidentally, in the case where the toner concentration of the liquid developer is high and the liquid amount is small, only by supplying the carrier liquid, it should be able to lower the toner concentration and to increase the liquid amount. However, conventionally, although the toner concentration is intended to be lowered, when the carrier liquid is supplied for liquid amount adjustment, supply of the supply agent by the non-interacting function is also carried out. In that case, compared with the case where the carrier liquid is only supplied, concentration lowering does not readily follow a speed thereof, and therefore, it takes a time until the toner concentration is lowered to the target value, and during the time, an image defect was liable to occur. Therefore, conventionally, in the case where the toner concentration of the liquid developer is high and the liquid amount is small, an apparatus capable of lowering the toner concentration to the target value and increasing the liquid amount by decreasing the supply amount of the supply agent by the non-interacting function to the extent possible has been desired, but such an apparatus has not yet been proposed.

The present invention has been accomplished in view of the above-described problem, and an object thereof is to provide an image forming apparatus capable of lowering the toner concentration to the target value and increasing the liquid amount by decreasing the supply amount of the supply agent by the non-interacting function to the extent possible in the case where the toner concentration of the liquid developer is high and the liquid amount is small.

Means for Solving the Problem

An image forming apparatus includes an image forming portion for forming an image with a liquid developer containing toner and a carrier liquid; a supplying device, accommodating the liquid developer, for supplying the liquid developer to the image forming portion during an image forming job; a liquid amount detecting means for detecting a liquid amount of the liquid developer in the supplying device; a concentration detecting means for detecting a concentration of toner relative to the liquid developer in the supplying device; a carrier liquid supplying device for supplying the carrier liquid to the supplying device; a supply agent supplying device for supplying, to the supplying device, and a supply agent higher in concentration than the liquid developer; and a control means for causing the carrier liquid supplying device to supply the carrier liquid and causing the supply agent supplying device to supply the supply agent, on the basis of respective detection results of the liquid amount supplying means and the concentration detecting means during the image forming job, wherein the control means acquires a first supply flow rate on the basis of a detection result of the concentration detecting means in a case that the concentration of the liquid developer detected by the concentration detecting means is higher than a first predetermined value and the liquid amount of the liquid developer detected by the liquid amount detecting means is less than a second predetermined value and sets a difference between a consumption amount of the liquid developer and the first supply flow rate at a second supply flow rate, and causes not only the carrier liquid supplying device to supply the carrier liquid in an amount in which the first supply flow rate and the second supply flow rate are added but also the supply agent supplying device to supply the supply agent in an amount depending on the second supply flow rate.

Effect of the Invention

According to the present invention, in the case where the concentration of the liquid developer is high and the liquid amount is small, when the concentration of the liquid developer is lowered to a target value and the liquid amount is increased, a supply amount of the supply agent can be decreased as small as possible, so that a time required for concentration adjustment of the liquid developer is capable of being shortened than a conventional constitution.

EMBODIMENTS FOR CARRYING OUT THE INVENTION

[Image Forming Apparatus]

Figure 1:
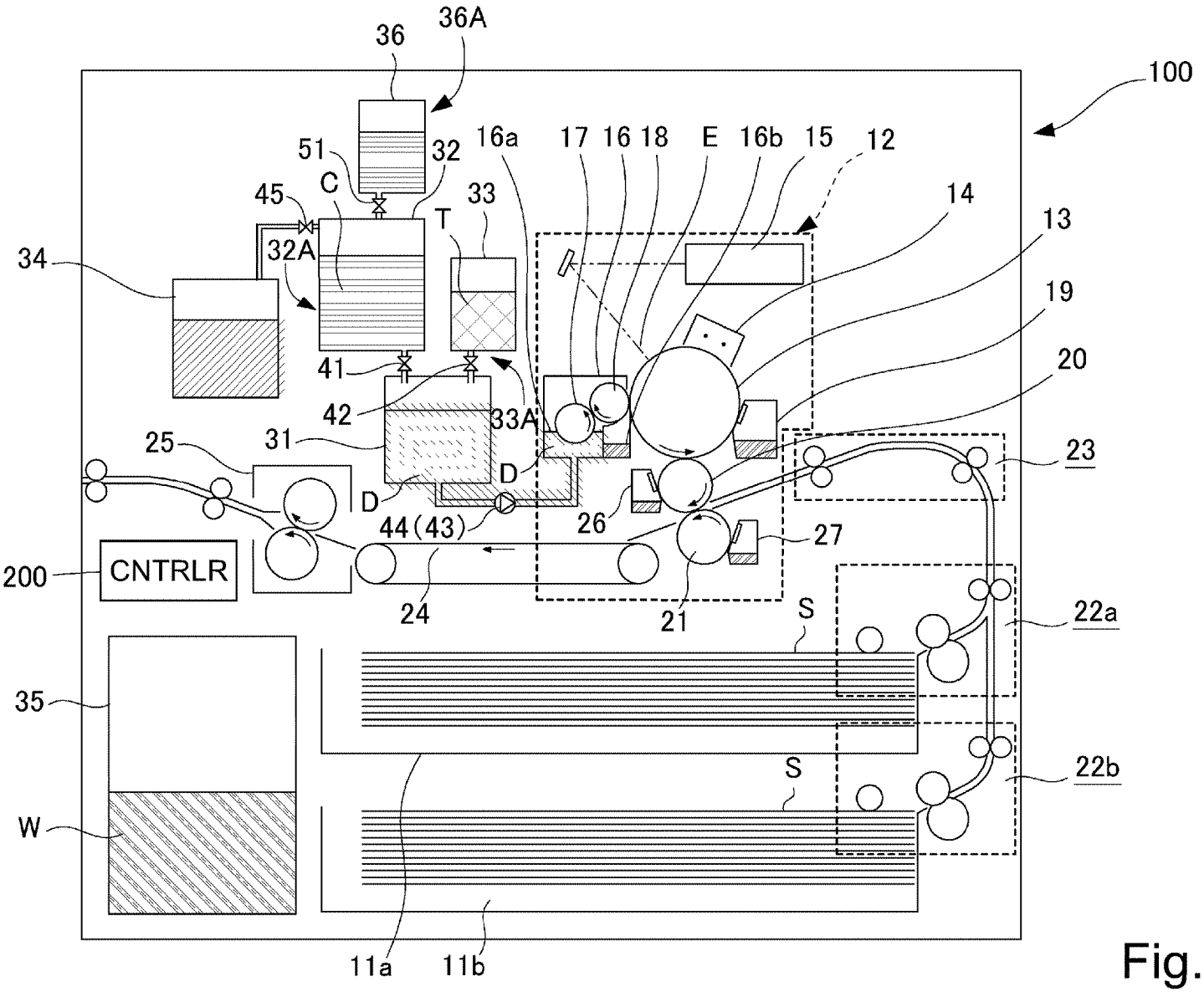
FIG. 1 is a schematic view showing a structure of an image forming apparatus according to this embodiment.

A general structure of an image forming apparatus in this embodiment will be described using FIG. 1. An image forming apparatus 100 in this embodiment is a digital printer of an electrophotographic type in which a toner image is formed on a recording material S (a sheet, a sheet material such as an OHP sheet and so on). The image forming apparatus 100 is operated on the basis of an image signal, and a toner image formed by an image forming portion 12 is transferred onto the sheet as the recording material is successively fed from each of cassettes 11*a*, 11*b* and then is fixed on the recording material S, so that an image is obtained. The image signal is sent from an external terminal such as an unshown scanner or an unshown personal computer.

The image forming portion 12 includes a photosensitive drum, a charger 14, a laser exposure device 15, a developing device 16 and a drum cleaner 19. A surface of the photosensitive drum 13 electrically charged by the charger 14 is irradiated with laser light E from the laser exposure device 15 depending on the first signal, so that an electrostatic latent image is formed on the photosensitive drum 13. This electrostatic latent image is developed as a toner image by the developing device 16. In this embodiment, in the developing device 16, a liquid developer D in which powdery toner which is a dispersoid is dispersed in a carrier liquid which is a dispersion medium is accommodated, and development is effected using this liquid developer D.

The liquid developer D is generated by mixing and dispersing toner in a carrier liquid in a predetermined ratio, As regards the liquid developer D, in a mixer 31 as a mixing device, a carrier liquid C and a liquid developer for supply high in concentration (hereinafter referred to as a supply agent T) are mixed, so that a toner concentration (concentration of a solid component) is adjusted, and the liquid developer D is supplied to the developing device 16. The carrier liquid C is accommodated in a carrier tank 32, and the supply agent T is accommodated in a supply agent tank 33. Then, depending on a toner concentration and a liquid amount in the mixer 31 (in a supplying device), the carrier liquid C and the supply agent T are supplied from the respective tanks. Supply of the carrier liquid C and the supply agent T to the mixer 31 will be described later. In the mixer 31, a stirring blade driven by an unshown motor is accommodated, and the supplied carrier liquid C and the supplied supply agent are stirred and are mixed with the already-existing liquid developer.

The liquid developer D supplied from the mixer 31 to the developing device 16 is coated (supplied) on a developing roller 18 and is used for development. The developing roller 18 carries and feeds the liquid developer D on a surface thereof, and develops with the toner the electrostatic latent image formed on the photosensitive drum 13 (image bearing member). The toner and the carrier liquid C which remain on the developing roller 18 after the development is collected in a collecting section 16*b* of the developing device 16. Here, each of coating of the liquid developer from a coating roller 17 onto the developing roller 18 and the development of the electrostatic latent image on the photosensitive drum 13 by the developing roller 18 is made using an electric field.

The toner image formed on the photosensitive drum 13 is transferred onto an intermediary transfer roller 20 using the electric field, and then is fed to a nip formed by the intermediary transfer roller 20 and a transfer roller 21. The toner T and the carrier liquid C which remain on the photosensitive drum 13 after the toner image transfer onto the intermediary transfer roller 20 are collected by the drum cleaner 19. Incidentally, at least one of the intermediary transfer roller 20 and the transfer roller 21 may also be an endless belt.

The recording material S accommodated in each of the cassettes 11*a*, 11*b* is fed toward a registration feeding portion 23 by an associated feeding portion 22*a* or 22*b* constituted by feeding rollers. The registration feeding portion 23 feeds the recording material S to the nip between the intermediary transfer roller 20 and the transfer roller 21 by being timed to the toner image transferred on the intermediary transfer roller 20.

In the nip between the intermediary transfer roller 20 and the transfer roller 21, the toner image is transferred onto the recording material S passing through the nip, and the recording material S on which the toner image is transferred is fed to a fixing device 25 by a feeding belt 24, so that the toner image transferred on the recording material S is fixed. The recording material S on which the toner image is fixed is discharged to an outside of the image forming apparatus, so that an imaging step is completed.

The intermediary transfer roller 20 and the transfer roller 21 are provided with an intermediary transfer roller cleaner 26 and a transfer roller cleaner 27, respectively, for collecting the toner and the carrier liquid C which remain on the associated roller.

(Liquid Developer)

Next, the liquid developer develop will be described. As the liquid developer D, a conventionally used liquid developer may also be used, but in this embodiment, an ultraviolet-curable liquid developer D is used and will be described below.

The liquid developer D is an ultraviolet-curable liquid developer which contains a cation-polymerizable liquid monomer, a photo-polymerization initiator and toner particles insoluble in the cation-polymerizable liquid monomer. The cation-polymerizable liquid monomer is vinyl ether compound, and the photo-polymerization initiator is a compound represented by the following formula (Chem 1).

formula (1)

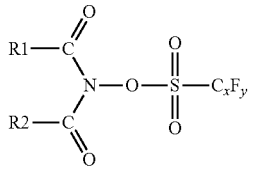

Specifically, first, the toner particles include a colorant and a toner resin material in which the colorant is incorporated. Together with the toner resin material and the colorant, another material such as a charge control agent may also be contained. As a manufacturing method of the toner particles, a well-known technique such as a coacervation in which the colorant is dispersed and a resin material is gradually polymerized so that the colorant is incorporated in the polymer or an internal pulverization method in which a resin material or the like is melted and the colorant is incorporated in the melted resin material may also be used. As the toner resin material, epoxy resin, styrene-acrylic resin or the like is used. The colorant may be a general-purpose organic or inorganic colorant. In the manufacturing method, in order to enhance a toner dispersing property, a dispersant is used but a synergist can also be used.

Next, a curable liquid which is the carrier liquid is constituted by the charge control agent for imparting electric charges to the toner surface, a photo-polymerization agent (initiator) for generating acid by ultraviolet (UV) irradiation and a monomer bondable by the acid. The monomer is a vinyl ether compound which is polymerizable by a cationic polymerization reaction. Separately from the photo-polymerization initiator, a sensitizer may also be contained. By photo-polymerization, a storage property lowers, and therefore a cationic polymerization inhibitor may also be added in an amount of 10-5000 ppm. In addition, a charge control aid, another additive or the like may also be used in some cases.

The UV curing agent (monomer) of the developer is a mixture of about 10% (weight %) of a monofunctional monomer having one vinyl ether group represented by a chemical formula (Chem 2 below) and about 90% (weight %) of difunctional monomer having two vinyl ether groups (represented by a chemical formula (Chem 3 below).

(Chem 2)

formula 2

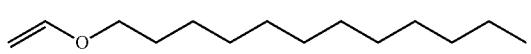

-continued (Chem 3)

formula 3

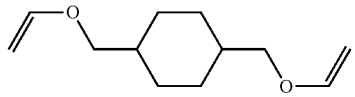

As the photo-polymerization initiator, 0.1% of a compound represented by (Chem 4) below is mixed. By using this photo-polymerization initiator, different from the case where an ionic photo-acid generator, a high-resistance liquid developer is obtained while enabling satisfactory fixing.

(Chem 4)

formula 4

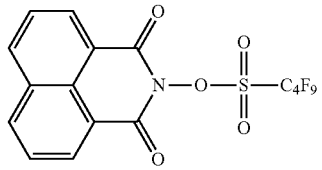

Incidentally, a cationic polymerizable liquid monomer may desirably be a compound selected from the group consisting of dichloropendadiene vinyl ether, cyclohexanedimethanol divinyl ether, tricyclodecane vinyl ether, trimethylolpropane trivinyl ether, 2-ethyl-1,3-hexamediol divinyl ether, 2,4-diethyl-1,5-pentanediol divinyl ether, 2-butyl-2-ethyl-1,3-propanediol divinyl ether, neopentylglycol divinyl ether, pentaerythritol tetravinyl ether, and 1,2-decanediol divinyl ether.

As the charge control agent, a well-known compound can be used. As a specific example, it is possible to use fats and oils such as linseed oil and soybean oil; alkyd resin; halogen polymer; oxidative condensates such as aromatic polycarboxylic acid, acidic group-containing water-soluble dye and aromatic polyamine; metallic soaps such as cobalt naphthenate, nickel naphthenate, iron naphthenate, zinc naphthenate, cobalt octylate, nickel octylate, zinc octylate, cobalt dodecylate, nickel dodecylate, zinc dodecylate, aluminum stearate, and cobalt 2-ethylhexylate; sulfonic acid metal salts such as petroleum acid metal salt and metal salt of sulfosuccinic acid; phospholipid such as lectithin; salicylic acid metal salt such as t-butylsalicylic acid metal complex; polyvinyl pyrrolidone resin; polyamide resin; sulfonic acid-containing resin; and hydroxybenzoic acid derivative.

(Feeding of Liquid Developer)

Next, feeding of the liquid developer D in this embodiment will be described using FIG. 2. A communicating pipe from the carrier tank 32 to the mixer 31 and a communicating pipe from the supply agent tank 33 to the mixer 31 are provided with a carrier supplying pump 41 and a supply agent supplying pump 42, respectively, and supply amounts of the carrier liquid C and the supply agent T are adjusted, so that the carrier liquid C and the supply agent T are supplied to the mixer 31. From the mixer 31, the liquid developer D necessary for the development is supplied using a pump 44. The developing device 16 is provided with a developer amount detecting device 160, and the developer amount detecting device 160 detects an amount of the liquid developer D in the developing device 16. Supply of the liquid developer D to the developing device 16 is carried out so that a detection value of the developer amount detecting device 160 is not less than a predetermined value (for example 200 cc±10 cc). Then, the toner and the carrier liquid which remain on the developing roller 18 after the development and which are collected into a collecting section 16*b* of the developing device 16 are returned to the mixer 31 by a circulating pump 43, and are used again. Incidentally, the toner and the carrier liquid collected into the collecting section 16*b* of the developing device 16 may also be fed to the separation and extraction device 34.

As described above, the toner and the carrier liquid C which are collected by the drum cleaner 19, the intermediary transfer roller cleaner 26 and the transfer roller cleaner 27 are fed to the separation and extraction device 34 as a separating device by pumps 48, 49 and 50, respectively. The separation and extraction device 34 separates the toner and the carrier liquid C by an electrolytic parting system, and makes the carrier liquid re-usable.

The separation and extraction device 34 separates, during separation of the carrier liquid and the toner, the liquid developer into a re-usable carrier liquid and waste fluid W containing impurities such as the toner and paper powder, and the separated re-usable carrier liquid is fed to the carrier tank 32 by a collected carrier feeding pump 45. On the other hand, the separated waste fluid W is fed to a waste fluid collecting container 35 by a pump 47.

The mixer 31 is provided with a solid component concentration (content) detecting device 311 as a concentration (content) detecting means, so that a toner concentration (specifically, a concentration of a solid component in the liquid developer) in the mixer 31 is detected. The solid component concentration detecting device 311 is, for example, provided with a light-emitting portion and a light-receiving portion, and a portion where the liquid developer D in the mixer 31 passes is irradiated with light from the light-emitting portion and then the light passing through the portion is received by the light-receiving portion. At that time, depending on the amount of the solid component such as the toner in the liquid developer, a light quantity of the light received by the light-receiving portion changes, and therefore depending on the change in light quantity, the toner concentration of the liquid developer D in the mixer 31 is capable of being detected.

In the mixer 31, a first float sensor 310 as a liquid amount detecting means for detecting the liquid amount of the liquid developer D is provided. Further, in the carrier tank 32, a second float sensor 320 as a carrier liquid amount detecting means for detecting a liquid amount of the carrier liquid C is provided. These first float sensor 310 and second float sensor 320 detect positions, i.e., liquid levels of floats floated on liquid surfaces, and capable of detecting the liquid amount of the liquid developer D in the mixer 31 and the liquid amount of the carrier liquid C in the carrier tank 32. As the first float sensor 310 and the second float sensor 320, for example, a float sensor in which a float provided with a magnet and a reed switch are provided and a position of the float is detected by the reed switch can be cited. Incidentally, the liquid amount detecting means may be one other than the float sensor.

[Supply of Supply Agent]

The image forming apparatus 100 of this embodiment includes a supply agent supplying device 33A for supplying the supply agent T to the mixer 31. The supply agent supplying device 33A is provided with a supply agent tank 33 and a supply agent supplying pump 42 provided to a communicating pipe for communicating the supply agent tank 33 and the mixer 31. In the supply agent tank 33, the toner or a high-concentration liquid developer (supply agent T) is accommodated. The supply agent T is higher in concentration than the liquid developer in the mixer 31.

The supply agent supplying device 33A supplies the supply agent T from the supply agent tank 33 to the mixer 31 at a predetermined supply flow rate in the case where the toner concentration of the liquid developer D in the mixer 31 is lower than a target value (first predetermined value). Further, the adjust supplying device 33A supplies the supply agent T from the supply agent tank 33 to the mixer 31 at a predetermined supply flow rate with execution of a non-interacting function described later in the case where the liquid amount of the liquid developer D in the mixer 31 is less than a predetermined amount (second predetermined value). The supply agent T is supplied from the supply agent tank 32 to the mixer 31 by the supply agent supplying pump 42.

[Supply of Carrier Liquid]

The image forming apparatus 100 of this embodiment includes a carrier liquid supplying device 32A for supplying the carrier liquid C to the mixer 31. The carrier liquid supplying device 32A is provided with the carrier tank 32 and a carrier supplying pump 41 provided to a communicating pipe for communicating the carrier tank 32 and the mixer 31. In the carrier tank 32, the carrier liquid C in which the carrier liquid separated by the separation and extraction device 34 and a carrier liquid for supply supplied by a supplying device 36A described later are mixed is accommodated.

The carrier liquid supplying device 32A supplies the carrier liquid C from the carrier amount tank 32 into the mixer 31 on the basis of a detection result of the first float sensor 310. Specifically, on the basis of the detection result of the first float sensor 310, when it is detected that the liquid amount of the liquid developer D in the mixer 31 is less than a predetermined amount, the carrier liquid C is supplied from the carrier tank 32 to the mixer 31 at a predetermined supply flow rate. Further, the carrier liquid supplying device 32A supplies the carrier liquid C from the carrier tank 32 to the mixer 31 at a predetermined supply flow rate in the case where the toner concentration of the liquid developer D is a target value or more. The carrier liquid C is supplied from the carrier tank 32 to the mixer 31 by the pump 41.

[Supply of Carrier Liquid for Supply]

In this embodiment, the image forming apparatus 100 includes a supplying device 36A for supplying the carrier liquid for supply to the carrier tank 32. The supplying device 36A includes a supplying carrier tank 36 and a supplying pump 51, of the carrier for supply, provided to a communicating pipe communicating the supplying carrier tank 36 with the carrier tank 32. In the supplying carrier tank 36, a new (fresh) carrier liquid as the carrier liquid is accommodated. The new carrier liquid has a volume resistivity of not less than 1.0E+14 Ω·cm, for example.

The supplying device 36A supplies the carrier liquid for supply from the supplying carrier tank 36 into the carrier tank 32 at a predetermined supply flow rate on the basis of the detection result of the second float sensor 320. Specifically, when it is detected that the liquid amount of the carrier liquid C in the carrier tank 32 is detected as being less than a third predetermined value on the basis of a detection result of the second float sensor 320, the carrier liquid for supply is supplied from the supplying carrier tank 36 to the carrier tank 32 by the pump 51.

[Controller]

Figure 2:
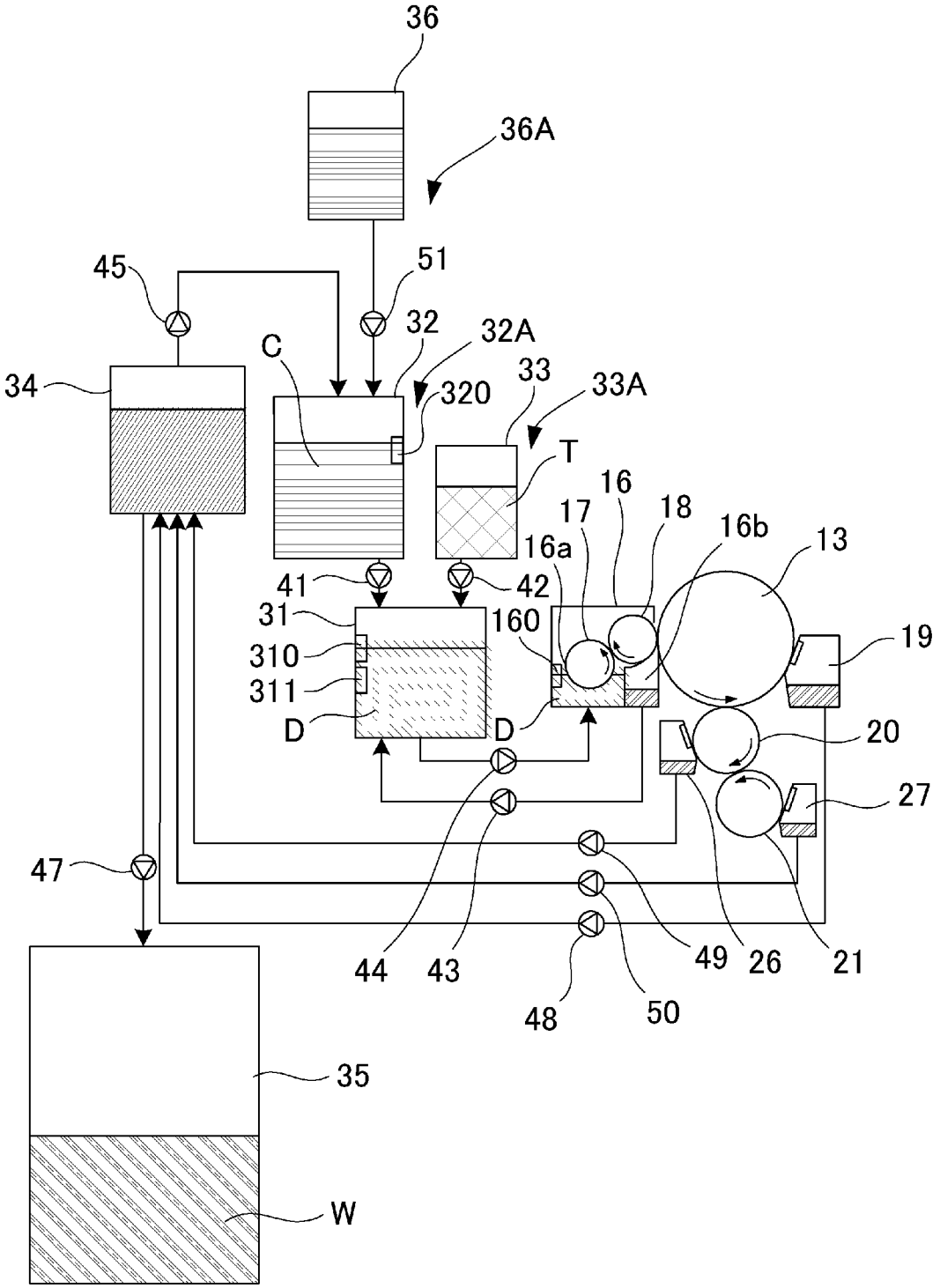
FIG. 2 is a schematic view showing a feeding path of a liquid developer.
Figure 3:
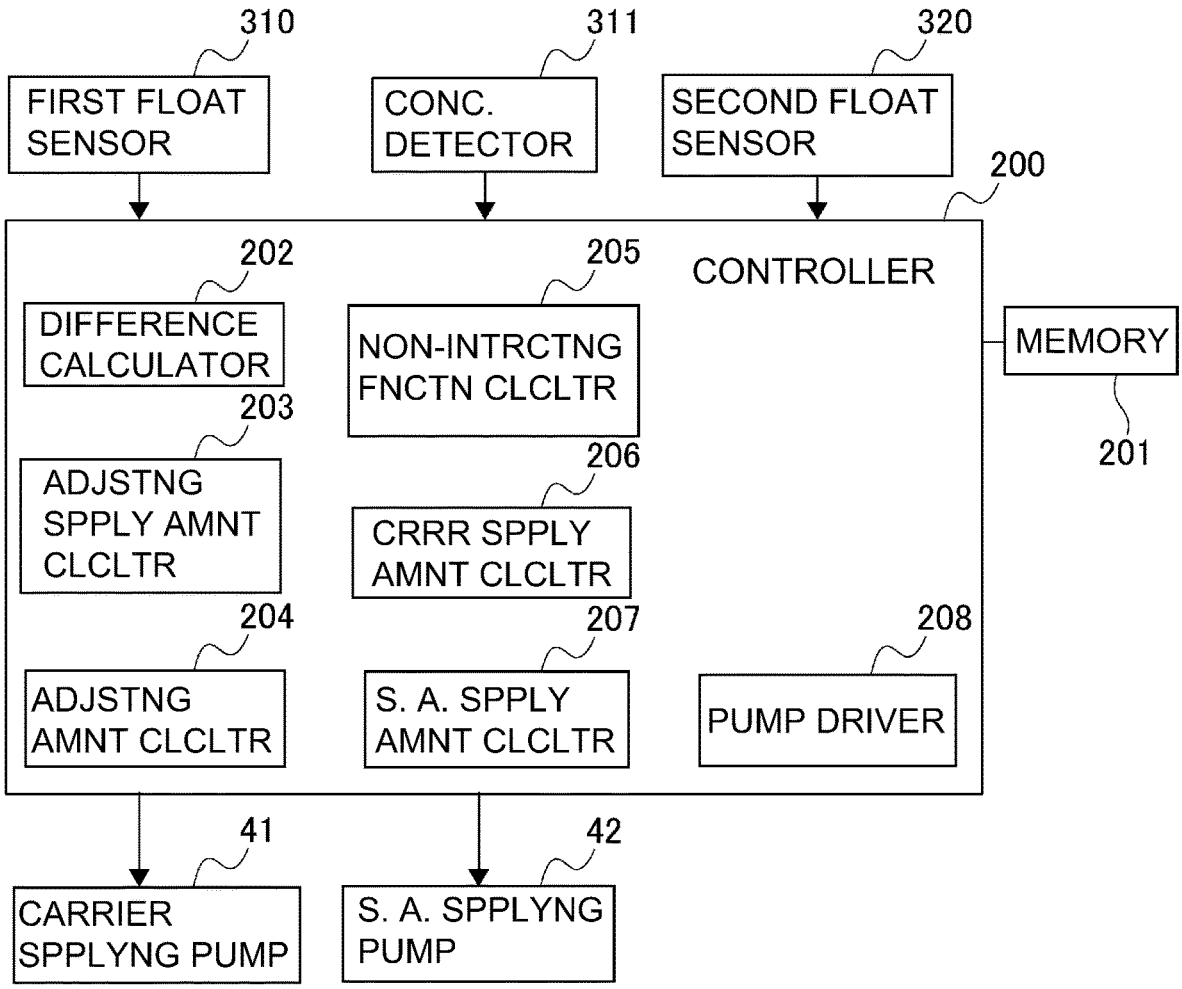
FIG. 3 is a control block diagram showing a supply control system of a supply agent and a carrier liquid.
Figure 9:
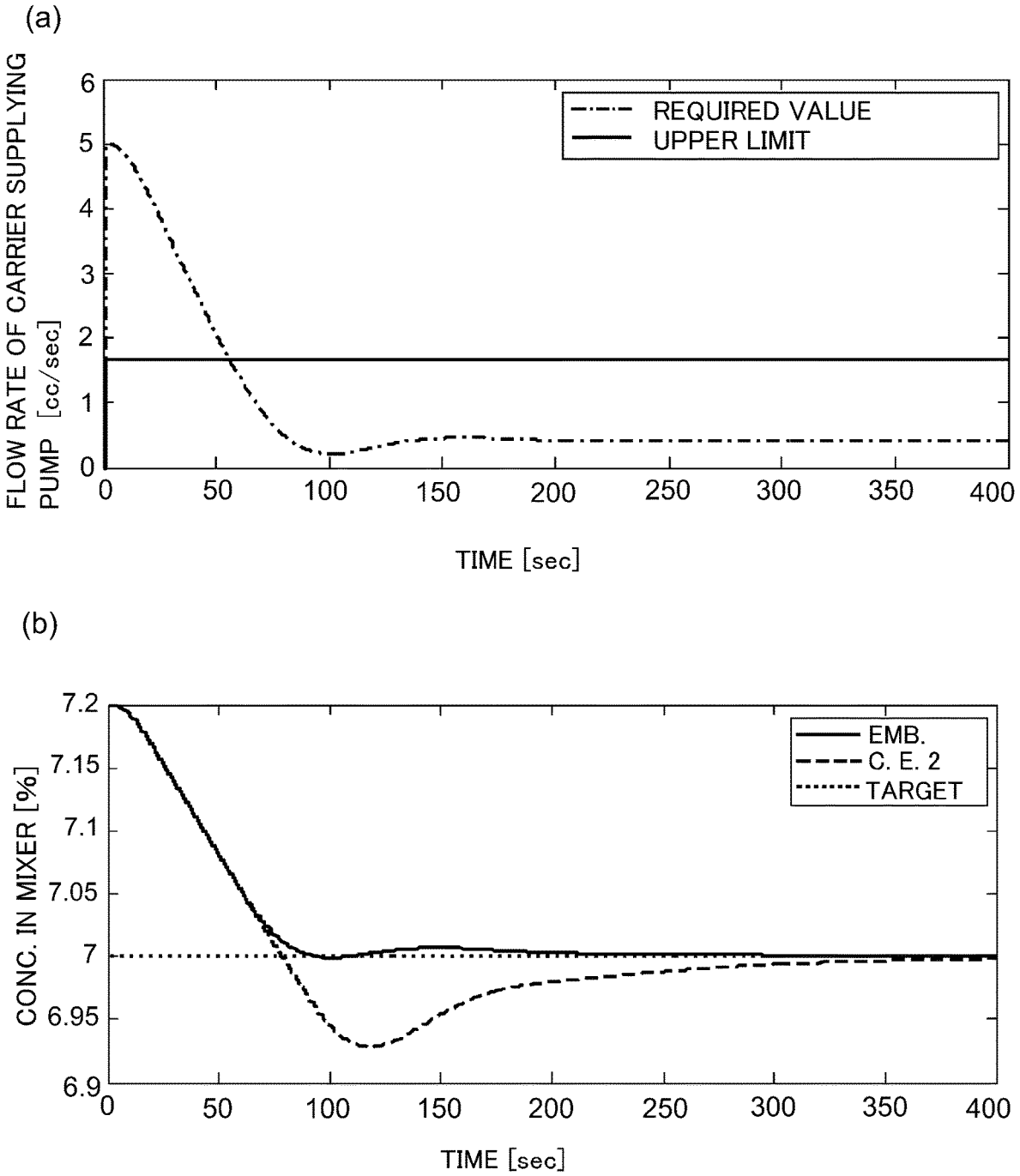
FIG. 9 includes schematic views for illustrating a deviation of the toner concentration from a target value in comparison with Comparison Example 1, wherein part (a) shows a timewise change in supply amount of the carrier supplying pump, and part (b) shows a timewise change in toner concentration of the liquid developer in the mixer.

The above-described supply of the supply agent T and the carrier liquid C and the supply of the carrier liquid for supply are controlled by a controller 200 (see FIG. 3). Supply control of the supply agent T and the carrier liquid C will be described using FIG. 3 to part (b) of FIG. 9 while making reference to FIGS. 1 and 2.

The image forming apparatus 100 includes the controller 200 as shown in FIG. 3. The controller 200 as a control means carries out various pieces of control of the image forming apparatus 100 such as an image forming operation, and includes an unshown CPU (Central Processing Unit), for example. A memory 201 is a storing means such as an ROM, an RAM or a hard disk device, for example. In the memory 201, various control programs, data and the like for controlling the image forming apparatus 100 are stored. The controller 200 executes an image forming job (image forming program) stored in the memory 201 and causes the image forming apparatus 100 to carry out image formation. Incidentally, the memory 201 is capable of temporarily storing a calculation process result or the like with execution of the various control programs.

The image forming job is a series of operations from a start of the image formation until the image forming operation is completed, on the basis of a print signal for forming the image on the recording material S. That is, the image forming job is a series of operations from a start of a preparatory operation (so-called a pre-rotation operation) required for carrying out the image formation until a preparatory operation (so-called a post-rotation) required for ending the image formation toner the image forming step. Specifically, the image forming job refers to the operations from the time of the pre-rotation (preparatory operation before the image formation) after receiving the print signal (input of the image forming job) to the post-rotation (operation after the image formation), and includes an image forming period and a sheet interval.

The controller 200 executes "Supply control of supply agent and carrier liquid" (see FIG. 5 to FIG. 6 described later) stored in the memory 201, and controls the image forming apparatus 100 (specifically the supply agent supplying device 33A and the carrier liquid supplying device 32A) so as to carry out supply of the supply agent T and the carrier liquid C. At that time, the controller 200 causes a pump driver 208 to operate the carrier supplying pump 41 and the supply agent supplying pump 42. The carrier supplying pump 41 is controlled so that the carrier liquid C is supplied to the mixer 31 at a supply flow rate (referred to as a carrier supply amount) of the carrier liquid C acquired by a consumption amount calculating portion 206. On the other hand, the supply agent supplying pump 42 is controlled so that the supply agent T is supplied to the mixer 31 at a supply flow rate (referred to as a supply agent supply amount) of the supply agent T acquired by a supply agent supply amount calculating portion 207. In the case of this embodiment, a pump driver 208 causes the carrier supplying pump 41 to operate by applying, to an unshown motor, a predetermined voltage depending on the carrier supply amount acquired by the carrier supply amount calculating portion 206, and causes the carrier supplying pump 41 to supply the carrier liquid C. Further, the pump driver 208 causes the supply agent supplying pump 42 to operate by applying, to an unshown motor, a predetermined voltage depending on the supply agent supply amount acquired by the supply agent supply amount calculating portion 207, and causes the supply agent supplying pump 42 to supply the supply agent T.

The carrier supply amount calculating portion 206 adds up a "carrier amount (supply amount) for concentration adjustment" calculated by a concentration adjustment supply amount calculating portion (PI controller) 203 and a "carrier amount (supply amount) for liquid amount adjustment" calculated by a liquid amount adjustment supply amount calculating portion 204 and acquires the carrier supply amount. The supply agent supply amount calculating portion 207 adds up the "carrier amount (supply amount) for concentration adjustment" calculated by the concentration adjustment supply amount calculating portion 203 and a "supply agent amount (supply amount) by non-interacting function" calculated by a non-interacting function calculating portion 205 and acquires the supply agent supply amount. A difference calculating portion 202 acquires a difference between a current toner concentration in the mixer 31 on the basis of a detection result of the solid component concentration detecting device 311 and a target value. The concentration adjustment supply amount calculating portion 203 calculates the carrier amount for concentration adjustment or the supply agent amount for concentration adjustment depending on the situation. Calculation and the like of the concentration adjustment supply amount calculating portion 203, the liquid amount adjustment amount calculating portion 204, the non-interacting function calculating portion 205, the carrier supply amount calculating portion 206 and the supply agent supply amount calculating portion 207 which are mentioned above will be described later.

[Supply Control of Supply Agent and Carrier Liquid]

Supply control of the supply agent and the carrier liquid executed by the controller 200 will be described with reference to FIGS. 4 to 6 while making reference to FIGS. 2 and 3. A supply control process of the supply agent and the carrier liquid shown in FIG. 4 is repetitively executed every predetermined time interval (for example, 100 milliseconds) in parallel to execution of an image forming job, i.e., during the image forming operation by the image forming apparatus 100.

Figure 4:
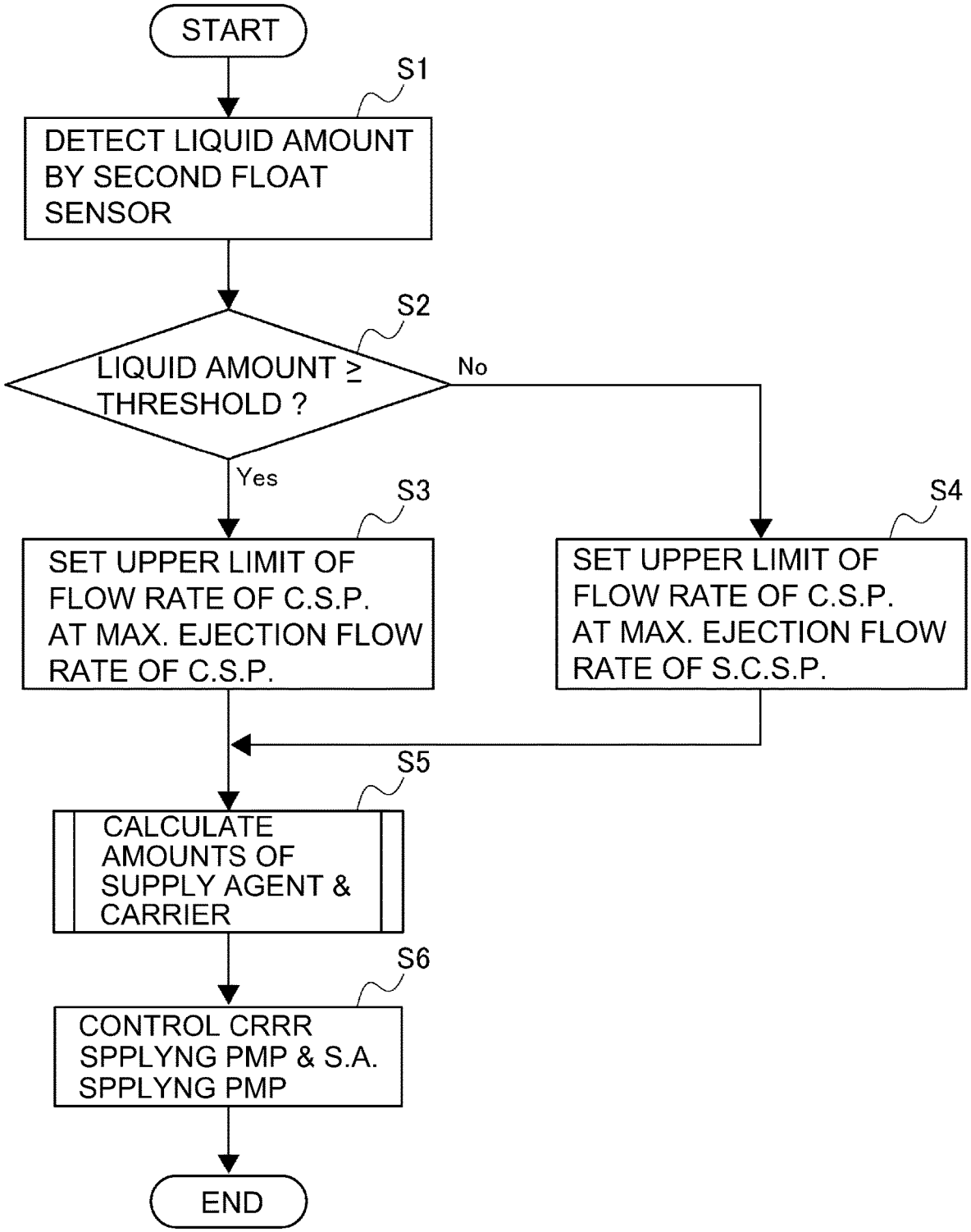
FIG. 4 is a flowchart showing a supply control process of the supply agent and the carrier liquid.

As shown in FIG. 4, the controller 200 detects the liquid amount of the carrier liquid C in the carrier tank 32 on the basis of the detection result of the second float sensor 320 in the carrier tank 32 (in the carrier liquid supplying device) (51). The controller 200 discriminates whether or not the liquid amount of the carrier liquid C in the carrier tank 32 is not less than a predetermined supply threshold (third predetermined value) (S2). In the case where the liquid amount of the carrier liquid C is not less than the predetermined supply threshold, i.e., in the case where there is no need to supply the carrier liquid for supply (YES of S2), the controller 200 sets a maximum ejection flow rate of the carrier supplying pump 41 as a "flow rate upper limit of carrier supplying pump 41" (S3).

On the other hand, in the case where the liquid amount of the carrier liquid C is less than the predetermined supply threshold, i.e., in the case where there is no need to supply the carrier liquid for supply (NO of S2), the controller 200 sets a maximum ejection flow rate of the carrier supplying pump for supply 51 as a "flow rate upper limit of carrier supplying pump 41" (S4). In this case, when the flow rate of the carrier supplying pump 41 is not less than the maximum ejection flow rate of the carrier supplying pump for supply 51, the liquid amount in the carrier tank 32 gradually decreases even when the carrier liquid for supply is supplied to the carrier tank 32, so that there is a liability that the carrier tank 32 becomes empty. In order to avoid this, in the case where the liquid amount of the carrier liquid C in the carrier tank 32 is less than the supply threshold, the "flow rate upper limit of carrier supplying pump 41" is switched from the maximum ejection flow rate of the carrier supplying pump 41 to the maximum ejection flow rate of the carrier supplying pump for supply 51.

The controller 200 executes a "calculating process of supply agent supply amount and carrier supply amount" acquiring the supply amount of the carrier supplied from the carrier tank 32 to the mixer 31 and the supply amount of the supply agent supplied from the supply agent tank 33 to the mixer 31 (S5). Specifically, as described later (see FIG. 5 and FIG. 6), in the "calculating process of supply agent supply amount and carrier supply amount", the supply agent supply amount and the carrier supply amount are acquired on the basis of detection results of the first float sensor 310 and the solid component concentration detecting device 311. After execution of the "calculating process of supply agent supply amount and carrier supply amount", the controller 200 controls the supply agent supplying device 33A (specifically the supply agent supplying pump 42) and supplies the supply agent T to the mixer 31 depending on the acquired supply agent supply amount (S6). Further, the controller 200 controls the carrier liquid supplying device 32A (specifically, the carrier supplying pump 41) and supplies the carrier liquid C to the mixer 31 depending on the acquired operation supply amount (S6).

The above-described "calculating process of supply agent supply amount and carrier supply amount" (see S5 of FIG. 4) will be described using FIG. 5. As shown in FIG. 5, the difference calculating portion 202 detects the toner concentration of the liquid developer D in the mixer 31 on the basis of the detection result of the solid component concentration detecting device 311 (S11). Then, the difference calculating pump 202 acquires a difference value "ΔF" between the acquired toner concentration "F" and a target value "Fref" in accordance with formula 1 shown below (S12). The target value "Fref" is stored in the memory 201 in advance.

$$\Delta D - F - F\mathrm{ref} \qquad \text{formula 1}$$

The concentration adjustment supply amount calculating portion 203 (PI controller) calculates a supply requirement (supply-required value) on the basis of the difference value "ΔF" acquired by the difference calculating portion 202 and an accumulated value of the difference value "ΔF" until the last calculation (S13). The accumulated value of the difference value "ΔF" the sum of difference values "ΔF" counted from the time of an initial agent of the liquid developer which has not been subjected to the development to an (n−1)-th time before an n-th "calculating process of supply agent supply amount and carrier supply amount" is executed. That is, the supply requirement is calculated in accordance with formula 2 shown below:

$$\text{Supply requirement} = (\alpha \times \Delta F(n)) + (\beta \times \Sigma \Delta F(n-1)) \qquad \text{formula 2}$$

Incidentally, a constant α and a constant β in the formula 2 are gain values calculated in advance in consideration of control stability, and here, both the constants "α" and "β" are positive. That is, in the case where the toner concentration in the mixer 31 is high, the carrier liquid C in a large amount compared with the supply agent T is supplied to the mixer 31, whereby the toner concentration in the mixer 31 increases. Further, the reason why the accumulated value of the difference value "ΔF" of the toner concentration is used in the concentration adjustment supply amount calculating portion 203 is that a steady-state deviation between the acquired toner concentration "F" and the target value "Fref" is eliminated.

The concentration adjustment supply amount calculating portion 203 discriminates whether or not the supply requirement is larger than 0, i.e., whether the supply requirement is positive or negative (S14). In the case where the supply requirement is larger than 0 (YES of S14), i.e., in the case where the toner concentration is lower than the target value, the concentration adjustment supply amount calculating portion 203 multiplies the supply requirement by a positive correction coefficient "γ1" and sets a resultant value at a supply agent supply requirement (S15). On the other hand, in the case where the supply requirement is 0 or less (NO of S114), i.e., in the case where the toner concentration is higher than the target value, the concentration adjustment supply amount calculating portion 203 multiplies the supply requirement by a negative correction coefficient "γ2" and sets a resultant value at a carrier supply requirement (S31). The above-described correction coefficients "γ1" and "γ2" are coefficients for adjusting outputs of the carrier supplying pump 41 and the supply agent supplying pump 42 so that during the supply of the supply agent and the carrier liquid, a concentration fluctuation in the same amount is caused to occur with respect to the supply requirement in the same supply agent.

After setting of the above-described supply agent supply requirement (S15), the adjust adjustment supply amount calculating portion 204 acquires a "carrier amount for liquid amount adjustment" by executing a "calculating process of carrier amount for liquid amount adjustment" (S16). Further, the non-interacting function calculating portion 205 calculates a "supply agent amount by non-interacting function" (S17). Further, in this case, the supply agent supply amount calculating portion 207 discriminates whether or not a combined (total) value of the "supply agent amount by non-interacting function" acquired in S17 and the "supply agent supply requirement" set in S15 is larger than the maximum ejection flow rate of the supply agent supplying pump 42 (S18). In the case where the combined value is larger than the maximum ejection flow rate of the supply agent supplying pump 42 (YES of S18), the supply agent supplying pump 42 sets the maximum ejection flow rate of the supply agent supplying pump 42 at the supply amount of the supply agent supplied to the mixer (S19). In this case, the concentration adjustment supply amount calculating portion 203 does not perform accumulation of the difference value "ΔF" (the above-described formulas 1 and 2) acquired by the difference calculating portion 202 (S20).

On the other hand, in the case where the combined value is not more than the maximum ejection flow rate of the supply agent supplying pump 42 (NO of S18), the supply agent supplying pump 42 sets the combined value of the "supply amount for concentration adjustment" and the "supply amount by non-interacting function" as the supply amount of the supply agent supplied to the mixer (S21). In this case, the concentration adjustment supply amount calculating portion 203 accumulates the difference values "ΔF" (the above-described formulas 1 and 2) acquired by the difference calculating portion 202.

After setting of the carrier supply requirement (S31), the concentration adjustment supply amount calculating portion 203 discriminates whether or not the carrier supply requirement is larger than the "flow rate upper limit of carrier supplying pump 41" acquired in S3 or S4 described above (S32). In the case where the carrier supply requirement is larger than the "flow rate upper limit of carrier supplying pump 41" (YES of S32), the concentration adjustment supply amount calculating portion 203 sets the "flow rate upper limit of carrier supplying pump 41" as the "carrier amount for concentration adjustment (first supply flow rate)" (S33). In this case, the concentration adjustment supply amount calculating portion 203 does not perform the accumulation of the difference value "ΔF" (the above-described formulas 1 and 2) acquired by the difference calculating portion 202 (S34).

On the other hand, in the case where the carrier supply requirement is not more than the "flow rate upper limit of carrier supplying pump 41" (NO of S32), the concentration adjustment supply amount calculating portion 203 sets the carrier supply requirement as the "carrier amount for concentration adjustment (first supply flow rate)" (S35). In this case, the concentration adjustment supply amount calculating portion 203 accumulates of the difference values "ΔF" (the above-described formulas 1 and 2) acquired by the difference calculating portion 202. Thereafter, the liquid amount adjustment amount calculating portion 204 executes the "calculating process of carrier amount for liquid amount adjustment" and sets a "carrier amount for liquid amount adjustment (second supply flow rate" (S36). Further, the non-interacting function calculating portion 205 calculates the "supply agent amount of non-interacting function" (S37). Further, in this case, the carrier supply amount calculating portion 206 sets, as the supply amount of the carrier supplied to the mixer 31, a value obtained by adding the "carrier amount for concentration adjustment" and the "carrier amount for liquid amount adjustment" (S38).

[Calculating Process of Carrier Amount for Liquid Amount Adjustment]

The above-described "calculating process of carrier amount for liquid amount adjustment" (see S19 and S36 of FIG. 5) will be described using FIG. 6. The liquid amount adjustment amount calculating portion 204 detects the liquid amount of the liquid developer Din the mixer 31 on the basis of a detection result of the first float sensor 310 in the mixer 31 (S51). The liquid amount adjustment amount calculating portion 204 discriminates whether or not the detected liquid amount of the liquid developer D in the mixer 31 is not more than a predetermined amount (for example 2.9 liters) (S52). In the case where the liquid amount of the liquid developer in the mixer 31 is more than the predetermined amount (NO of S52), the liquid amount adjustment amount calculating portion 204 sets "0" as the "carrier amount for liquid amount adjustment" (S56).

On the other hand, in the case where the liquid amount of the liquid developer D in the mixer 31 is not more than the predetermined amount (YES of S52), the liquid amount adjustment amount calculating portion 204 acquires a supply amount (lower limit) of the carrier supplied to the mixer 31, depending on an image ratio (also referred to as image Duty) (S53). This carrier supply amount is a minimum supply amount (lower limit) in which the liquid developer D in the mixer 31 does not become depleted during the image forming job and is a consumption amount of the liquid developer D in the mixer 31 consumed depending on the image ratio of the image formed during the image formation. The image ratio used here may preferably be an average image ratio calculated every 100 sheets of the recording materials S, for example. Incidentally, in the case of this embodiment, the above-described carrier supply amount has been renewed by being multiplied by a predetermined coefficient. This is because the liquid amount of the liquid developer in the mixer 31 is restored earlier. Specifically, the coefficient is about 1.2, for example.

Then, the liquid amount adjustment calculating portion 204 compares the carrier supply amount acquired by S53 described above with the carrier amount for concentration adjustment set in S18 (or S34) described above (S54). In the case where the carrier amount for concentration adjustment is not less than the carrier supply amount (NO of S54), the liquid amount adjustment amount calculating portion 204 sets "0" as the "carrier amount for liquid amount adjustment" (S56). In this case, the liquid amount of the liquid developer D in the mixer 31 can be restored only be supplying the carrier liquid C in an amount corresponding to the carrier amount for concentration adjustment, so that after the carrier liquid C in the amount corresponding to the carrier amount for concentration adjustment is supplied, there is no need to separately supply the carrier liquid C for liquid amount adjustment. Therefore, the "carrier amount for liquid amount adjustment" is set at "0". On the other hand, in the case where the carrier amount for concentration adjustment is less than the carrier supply amount (YES of S54), the liquid amount adjustment calculating portion 204 subtracts the "carrier amount for concentration adjustment" from the carrier supply amount and sets a resultant value at the "carrier amount for liquid amount adjustment" (S55). In other words, a difference between a consumption amount per unit time of the liquid developer D consumed with the image formation and the "carrier amount for concentration adjustment" at the "carrier amount for liquid amount adjustment". In this case, the liquid amount of the liquid developer D in the mixer 31 cannot be restored when the carrier liquid C in the amount corresponding to the carrier amount for concentration adjustment is only supplied, and therefore, in addition to the carrier amount for concentration adjustment, there is a need to separately supply the carrier liquid. Therefore, the setting of the "carrier amount for liquid amount adjustment" is carried out in the above-described manner.

[Calculation of Supply Agent Amount by Non-Interacting Function]

Calculation of the above-described "supply agent amount by non-interacting function" (see S20 and S37 of FIG. 5) will be described. As already described above, in the case where the carrier supplying pump 41 is operated and the carrier liquid C is supplied from the carrier tank 32 in order to increase the liquid amount of the liquid developer D in the mixer 31, the toner concentration of the liquid developer D in the mixer 31 lowers with the supply of the carrier liquid C. Therefore, in order to prevent a change in toner concentration of the liquid developer D before and after the supply of the carrier liquid C due to the supply of the carrier liquid C for an increase in liquid amount, i.e., in order to maintain the toner concentration, separately from the carrier liquid C, the supply agent T is supplied to the mixer 31. The "supply agent amount by non-interacting function" supplied at this time is calculated in accordance with formula 3 shown below.

$$Q2=x/(x0-x)\times Q1 \qquad \text{formula 3}$$

Here, a "Q1" in the formula 3 represents the liquid amount (carrier amount for liquid amount adjustment) of the carrier liquid C supplied to the mixer 31 by the carrier supplying pump 41. A "Q2" in the formula 3 is a supply amount in which even when the carrier liquid C in the liquid amount "Q1" is supplied by the carrier supplying pump 41, the toner concentration of the liquid developer D can be maintained before and after the supply of the carrier liquid C. A variable "x" in the formula 3 is a toner concentration of the liquid developer D in the mixer 31 before the carrier liquid C in the liquid amount "Q1" is supplied. A variable "x0" in the formula 3 in a toner concentration of the supply agent T in the supply agent tank 33.

Figure 7:
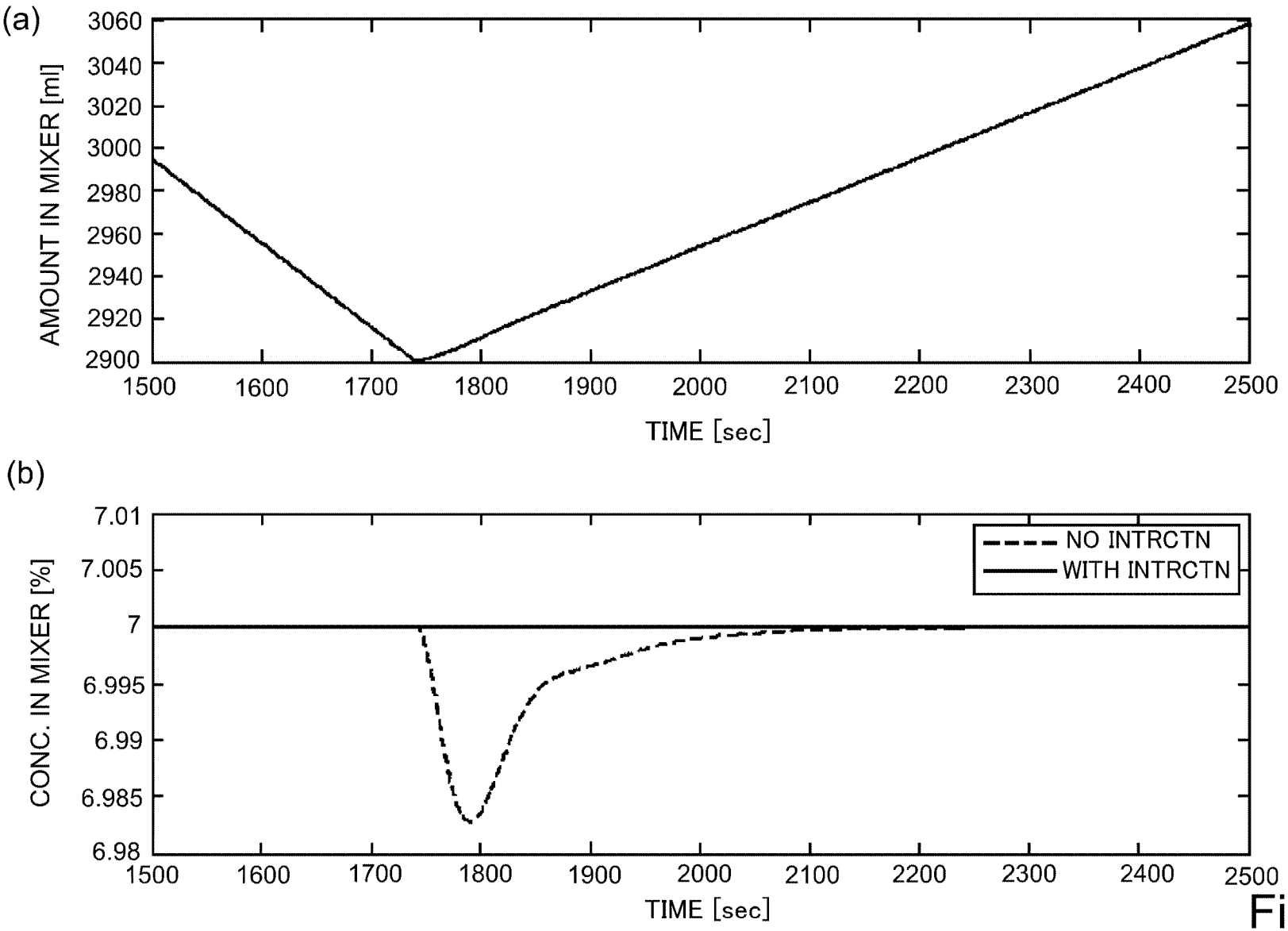
FIG. 7 includes a schematic views for illustrating an effect of non-interacting function, wherein part (a) shows a timewise change in liquid amount of the liquid developer in a mixer, and part (b) shows a timewise change in toner concentration of the liquid developer in the mixer.

In the non-interacting function, when the carrier liquid C in the liquid amount "Q1" is supplied by the carrier supplying pump 41, in order to maintain the toner concentration of the liquid developer D before and after the supply of the carrier liquid C, the supply agent T in the liquid amount "Q2" is supplied by the supply agent supplying pump 42. Here, an effect of the non-interacting function will be described using part (a) of FIG. 7 and part (b) of FIG. 7 while making reference to FIG. 2. Part (a) of FIG. 7 shows a timewise change in liquid amount of the liquid developer D in the mixer 31, and part (b) of FIG. 7 shows a timewise change in toner concentration of the liquid developer D in the mixer 31. In part (b) of FIG. 7, a solid line represents the case where the non-interacting function is performed, and a broken line represents the case where the non-interacting function is not performed. Incidentally, here, the case where a target value of the toner concentration of the liquid developer D in the mixer 31 is 7.0% and a lower limit (predetermined amount) of the liquid amount of the liquid developer D in the mixer 31 is 2.9 liters will be described as an example.

As shown in part (a) of FIG. 7, when the liquid amount of the liquid developer D in the mixer 31 is below 2.9 liters, the carrier supplying pump 41 is operated, so that the carrier liquid C is supplied from the carrier tank 32 to the mixer 31. Thereafter, the liquid amount of the liquid developer D in the mixer 31 increases. In this case, as shown by the broken line of part (b) of FIG. 7, when the non-interacting function is not performed, the toner concentration temporarily decreases depending on a start of the supply of the carrier liquid C to the mixer 31 and deviates from the target value. On the other hand, as shown by the solid line of part (b) of FIG. 7, when the non-interacting function is performed depending on the supply of the carrier liquid C, the supply agent T is supplied, so that the toner concentration is maintained at the target value without being decreased.

As described above, the toner concentration of the liquid developer D in the mixer 31 is lowered by the carrier liquid C supplied for liquid amount adjustment, and therefore, in order to avoid this, the supply agent in an amount in which the toner concentration can be maintained before and after the supply of the carrier liquid C by the non-interacting function is supplied. Also, in the case of this embodiment, when the liquid amount of the liquid developer in the mixer 31 is less than the predetermined amount, with the supply of the carrier liquid C for liquid amount adjustment, the supply agent T is supplied by the non-interacting function. However, in that case, when the toner concentration is higher than the target value, the supply agent T is supplied although the toner concentration is intended to be lowered, so that compared with the case where the toner concentration is lowered by supplying only the carrier liquid C, it takes time to arrival of the toner concentration at the target value. That is, followability of the toner concentration with respect to the supply of the carrier liquid C and the supply agent T is not good, and therefore, an image defect is liable to occur.

In view of the above-described point, in the image forming apparatus 100 in which the carrier liquid is supplied to the mixer 31 for the purpose of the concentration adjustment and the liquid amount adjustment, there is a need that the carrier amount for liquid amount adjustment is made small to the extent possible. For that reason, only in the case where the carrier amount for liquid amount adjustment is not enough to restore the liquid amount of the mixer 31, it is preferable that the carrier liquid is supplied additionally for liquid amount adjustment. By this, in this embodiment, in the case where the toner concentration of the liquid developer D is high and the liquid amount is small, the amount of the supply agent T by the above-described non-interacting function is decreased compared with the conventional amount, so that the followability of the toner concentration is capable of being improved. Incidentally, a total supply flow rate of the carrier liquid C and the supply agent T which are supplied to the mixer 31 is not less than the consumption amount per unit time of the liquid developer consumed with the image formation, so that the mixer 31 is prevented from becoming depleted.

Figure 8:
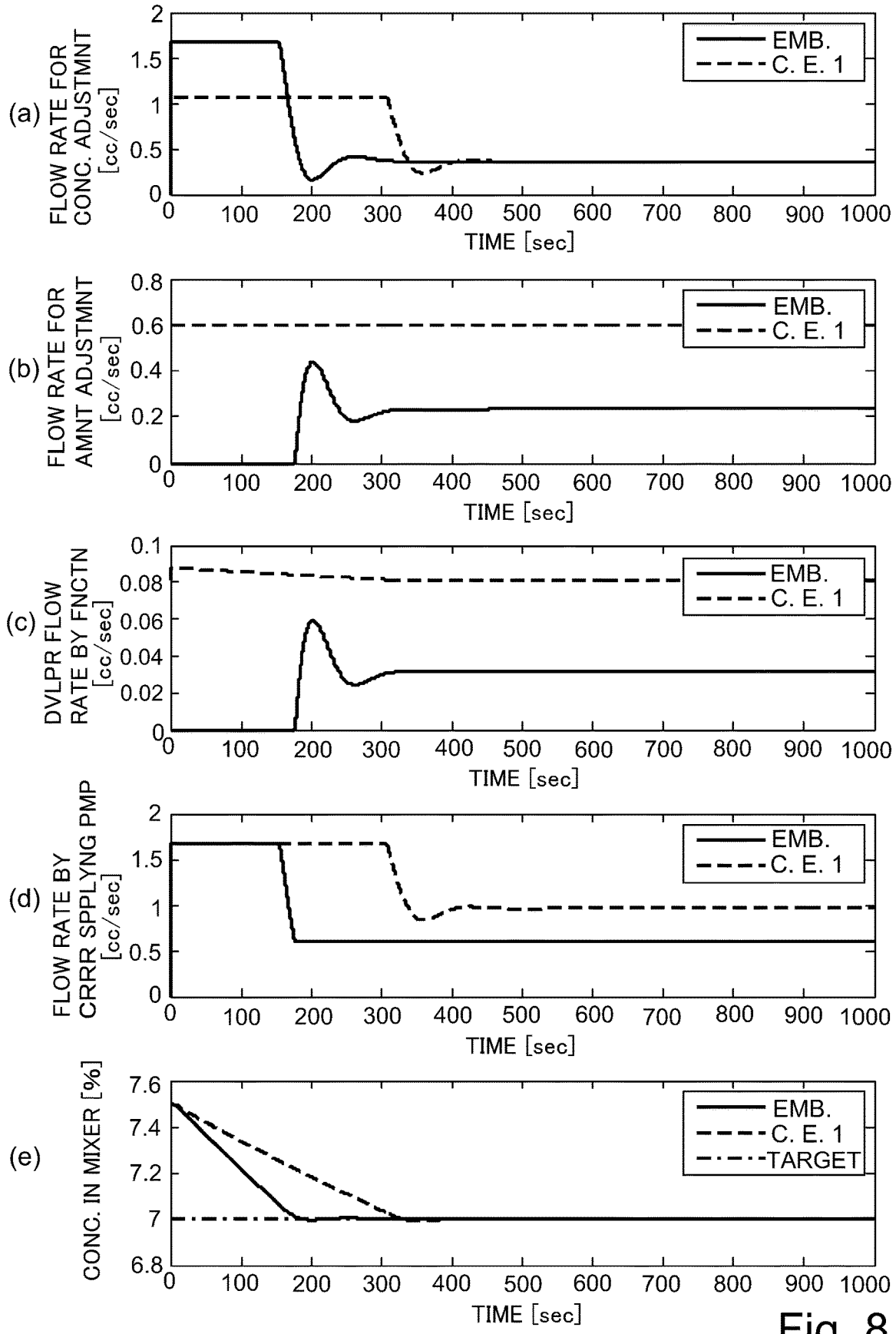
FIG. 8 includes schematic views for illustrating followability of the toner concentration in comparison with Comparison Example 1, wherein part (a) shows a timewise change in carrier amount for concentration adjustment, part (b) shows a timewise change in carrier amount for liquid amount adjustment, part (c) shows a timewise change in supply agent amount by a non-interacting function, part (d) shows a timewise change in supply amount of a carrier supplying pump, and part (e) shows a timewise change in toner concentration of the liquid developer in the mixer.

The followability of the toner concentration in this embodiment will be described using part (a) of FIG. 8 to part (e) of FIG. 8. Part (a) of FIG. 8 to part (e) of FIG. 8 are schematic views for illustrating the followability of the toner concentration in this embodiment and in Comparison Example 1. Comparison Example 1 shown by dotted lines in the figures in the case where the carrier amount for liquid amount adjustment is always a certain amount irrespective of the carrier amount for concentration adjustment. Incidentally, a state in which an initial concentration of the toner of the liquid developer in the mixer 31 is 7.5% and the supply of the carrier liquid C is needed for liquid amount adjustment is assumed. Further, an image outputting mode in which the flow rate of the carrier supplying pump 41 required to supply the carrier liquid for restoring the liquid amount in the mixer 31 is 0.5 cc/sec is assumed. Further, it is assumed that an upper limit of the flow rate of the carrier supplying pump 41 is about 1.6 cc/sec.

Figure 5:
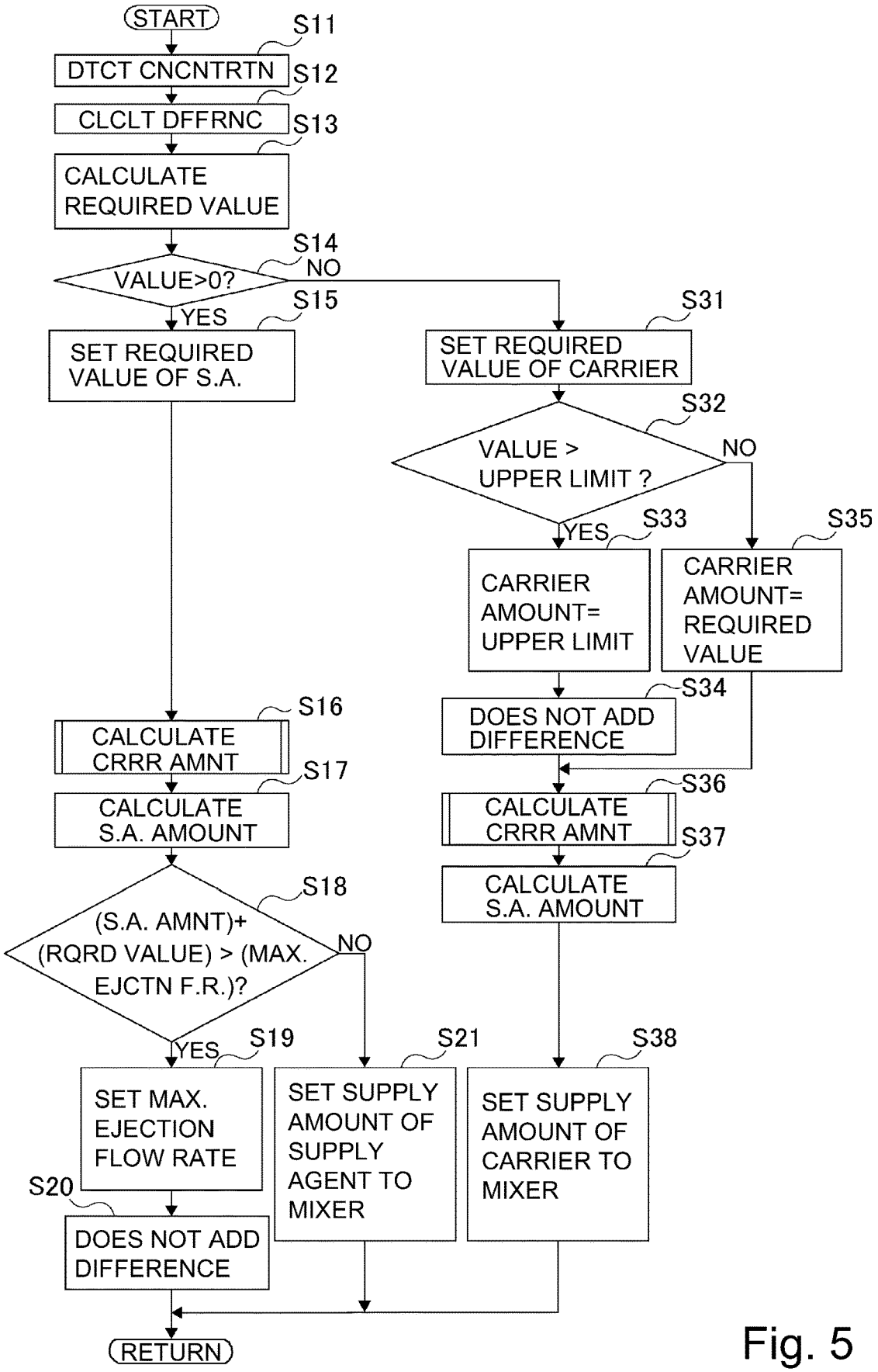
FIG. 5 is a flowchart showing a supply amount calculating process of the supply agent and the carrier liquid.
Figure 6:
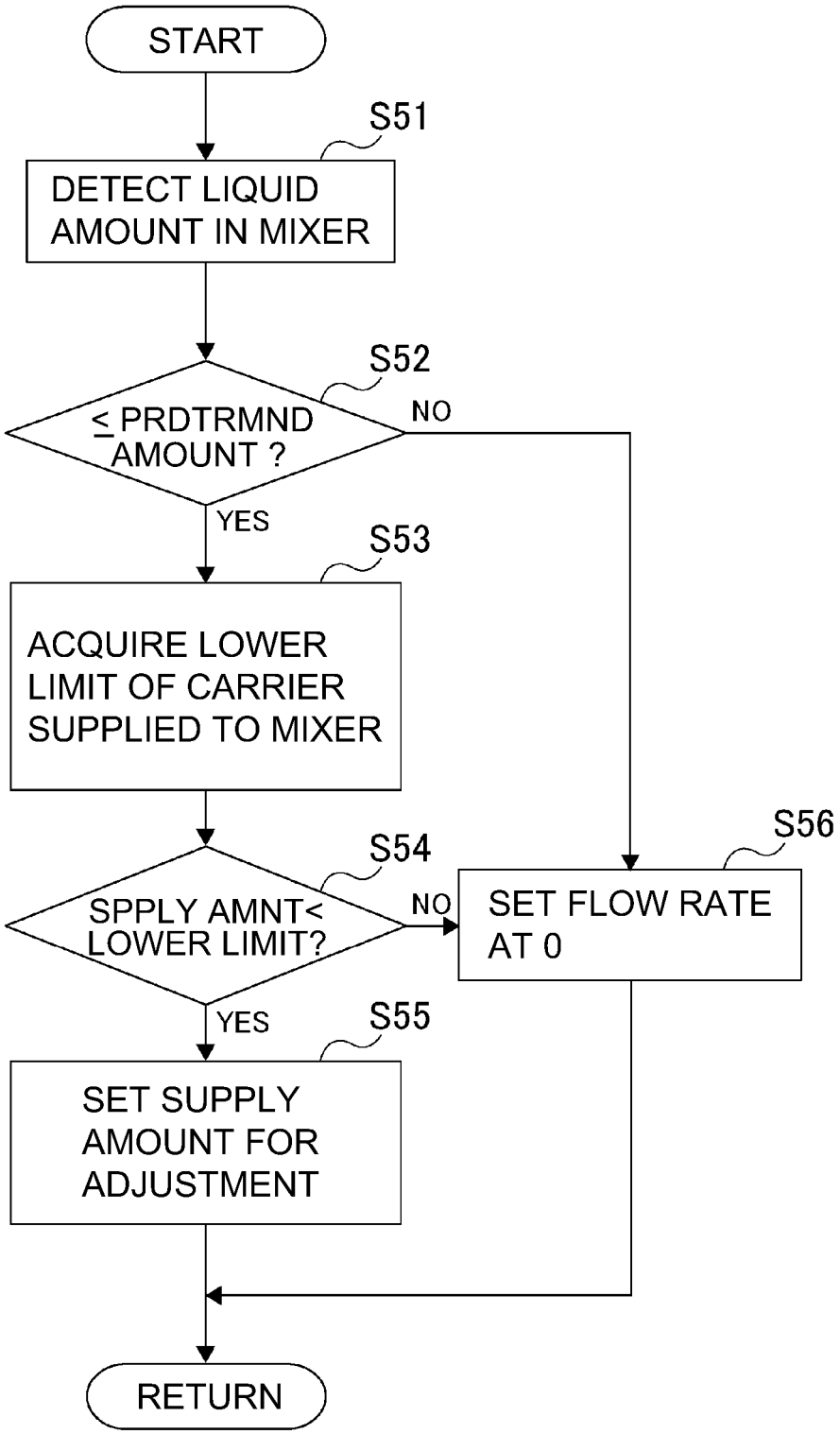
FIG. 6 is a flowchart showing a supply amount calculating process of a carrier liquid for liquid amount adjustment.

As described in S53 of FIG. 5 mentioned above, a value obtained by multiplying the flow rate of 0.5 cc/sec by a coefficient is a minimum supply agent (lower limit) in which the liquid amount of the liquid developer D in the mixer 31 can be stored, and therefore, when the coefficient is 1.2, the lower limit is 0.6 cc/sec. In the case of the above-described state, in order to lower the toner concentration of the liquid developer in the mixer 31, the carrier liquid C is supplied from the carrier supplying pump 41 into the mixer 31. Further, the initial concentration of the toner of the liquid developer in the mixer 31 is higher than the target value, and therefore, as shown in part (a) of FIG. 8, the amount of the carrier required to be supplied for concentration adjustment becomes large in a period of 0-150 sec, so that as shown in part (d) of FIG. 8, the flow rate reaches an upper limit of the flow rate of the carrier supplying pump 41. At this time, in Comparison Example 1, irrespective of a magnitude of the flow rate for concentration adjustment, the flow rate for liquid amount adjustment is kept constant, and therefore, a value shown in part (b) of FIG. 8 is a certain value. On the other hand, in this embodiment, the carrier amount for concentration adjustment is an amount enough to restore the liquid amount of the mixer 31, and therefore, in a time in which the carrier amount for concentration adjustment exceeds 0.6 cc/sec, as shown in part (b) of FIG. 8, the carrier amount for liquid amount adjustment is not set and is 0. Further, when the carrier amount for concentration adjustment is below 0.6 cc/sec, the carrier amount for liquid amount adjustment is set, so that the carrier liquid C is supplied for liquid amount adjustment.

As shown in part (c) of FIG. 8, in Comparison Example 1, the supply agent T is supplied in a supply amount depending on the flow rate of part (b) of FIG. 8 by the non-interacting function, so that the supply agent T is continuously supplied also in the period of 0-150 sec by the non-interacting function. On the other hand, in the case of this embodiment, in the period of 0-150 sec, the flow rate for liquid amount adjustment is 0, so that the supply of the supply agent T by the non-interacting function is not carried out. As a result, as shown in part (e) of FIG. 8, convergence at the target value in this embodiment is faster compared with the Comparison Example 1. That is, the followability of the toner concentration is good.

As described above, in this embodiment, when the supply flow rate of the carrier liquid in the case where concentration adjustment and liquid amount adjustment are simultaneously performed for the carrier supplying pump 41, the "carrier amount for concentration adjustment" was preferentially assigned, and a remaining carrier amount was assigned to the "carrier amount for liquid amount adjustment". By doing so, in the case where the toner concentration of the liquid developer D in the mixer 31 is high and the liquid amount is small, the supply agent T supplied to the mixer 31 by the non-interacting function can be made small in amount compared with the conventional constitution. That is, the carrier liquid C can be supplied while decreasing the supply agent T more than the conventional constitution, so that the liquid amount can be easily satisfied while improving the followability of the toner concentration, i.e., while shortening the time required for concentration adjustment of the liquid developer more than the conventional constitution.

Incidentally, in the above-described concentration adjustment supply amount calculating portion 203 (PI controller), when the supply requirement of the carrier liquid is calculated (see S13 of FIG. 5), the accumulated value of the difference values "ΔF" is used. This is because the stead-state deviation between the acquired toner concentration "F", i.e., a current toner concentration and the target value "Fref" is eliminated. However, when a deviation between the current toner concentration and the target value is increased by the influence of, for example, a large disturbance or the like, the difference value of the toner concentration becomes large, so that the supply requirement exceeds the maximum ejection flow rate of the carrier supplying pump 41 in some instances. In this case, when the amount of the carrier supplied to the mixer 31 is calculated as usual, even when the current toner concentration reaches the target value, the carrier supply amount calculated on the basis of the difference accumulated before then becomes excessively large, with the result that the toner concentration can overshoot the target value.

In view of this point, although description was made in S23 and S34 of FIG. 5 in this embodiment, in the case where the supply agent supply requirement or the carrier supply requirement exceeds the upper limit of the flow rate of the supply agent supplying pump 42 or the carrier supplying pump 41, respectively, the accumulation of the difference value "ΔF" of the toner concentration is not carried out. Addition of the difference "ΔF" calculated by the above-described formula (1) to the difference accumulation "ΣΔF" is stopped, and then when the calculation of S13 of FIG. 5 is performed at next timing, the supply agent amount for concentration adjustment and the carrier amount for concentration adjustment are calculated on the basis of this. Incidentally, the upper limit of the flow rate of the carrier supplying pump 41 is a value set in S3 or S4 of FIG. 4, and the upper limit of the flow rate of the supply agent supplying pump 42 is the maximum ejection flow rate of the pump 42.

In the case where execution selection of the accumulation of the difference values "ΔF" of the above-described toner concentration is not carried out, supply control (PI control) of the supply agent T and the carrier liquid C is carried out for toner concentration adjustment of the liquid developer in the mixer 31. That is, even when the supply requirement is any value, control such that the difference ΔF with the target value is added to the difference accumulation ΣΔF and subsequent supply amounts of the supply agent T and the carrier liquid C are calculated on the basis of the difference and the difference accumulation is carried out. This is used as Comparison Example 2, and results of comparison of effects the supply control of the supply agent T and the carrier liquid C in the cases of this embodiment and Comparison Example 2 were shown in part (a) of FIG. 9 and part (b) of FIG. 9.

In the case where the toner concentration in the mixer 31 is high (for example, 7.2%), the carrier liquid C is supplied for concentration adjustment to the mixer 31 by the carrier supplying pump 41. However, as shown in part (a) of FIG. 9, when the supply requirement of the carrier liquid exceeds the upper limit (see S3 and S4 of FIG. 4) of the flow rate of the carrier supplying pump 41, an actual supply amount of the carrier liquid C is limited to the upper limit of the flow rate of the carrier supplying pump 41. Nevertheless, the concentration adjustment supply amount calculating portion 203 (PI controller) calculates the difference accumulation "ΣΔF", so that the supply requirement becomes large. As a result, the difference accumulation "ΣΔF" is accumulated by a value deviated from an actual value, whereby the toner concentration is deviated from the target value as shown by a think dotted line of part (b) of FIG. 9. On the other hand, in this embodiment, in the case where the carrier supply requirement exceeds the upper limit of the flow rate of the carrier supplying pump 41, the calculation of the difference accumulation "ΣΔF" is not performed, whereby the deviation of the toner concentration from the target value can be made small compared with Comparison Example 2 as shown by a solid line of part (b) of FIG. 9.

Other Embodiments

Figure 10:
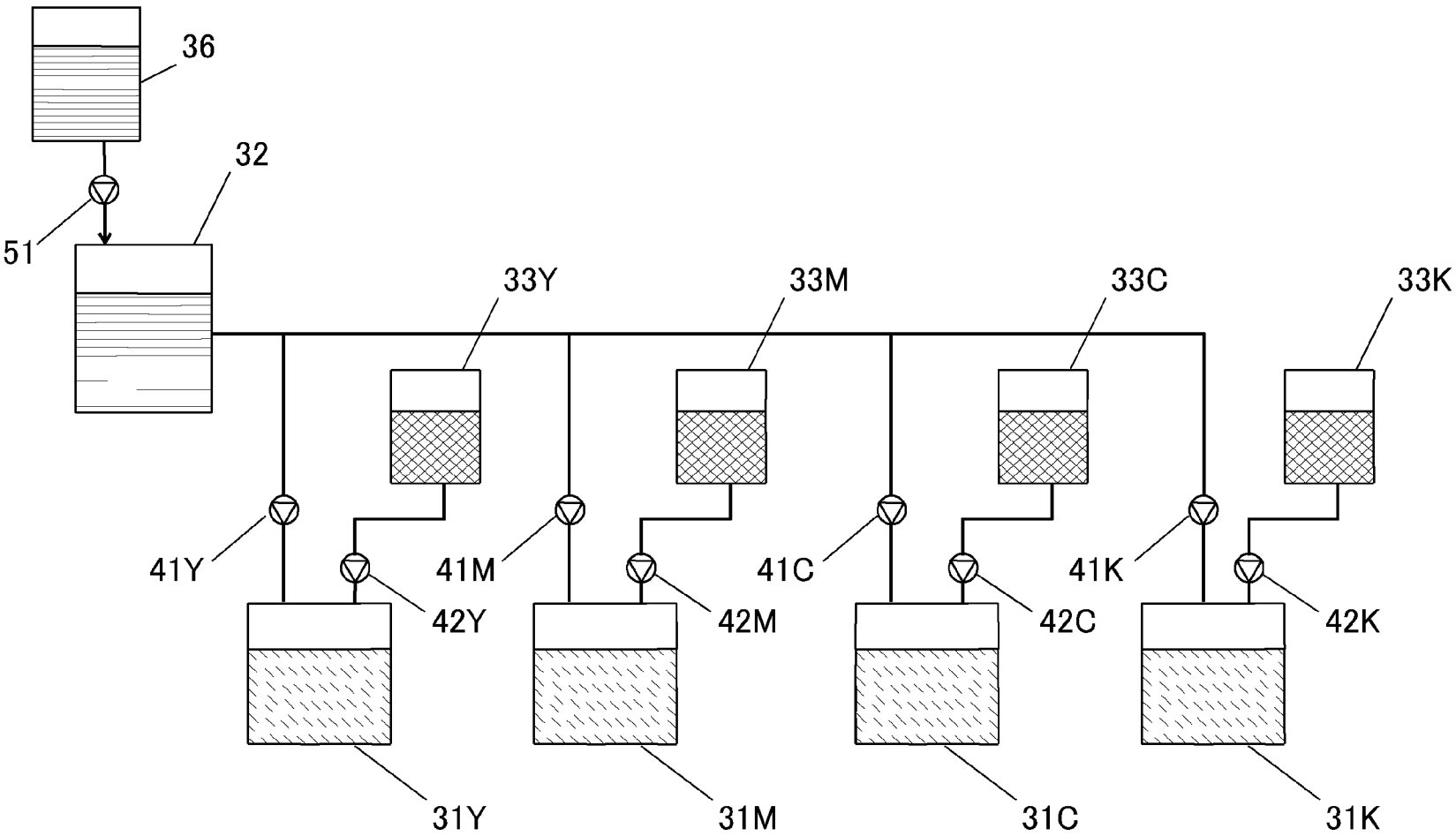
FIG. 10 is a schematic view showing a constitution in which the carrier liquid is supplied to a plurality of mixers by a single carrier tank.

In the above-described embodiments, as shown in FIG. 2, a constitution in which a monochromatic (single-color) image forming portion 12 for supplying the carrier liquid C from the carrier tank 32 to the single mixer 31 was shown, but the present invention is not limited thereto. For example, a constitution including four image forming portions capable of forming toner images of respective colors of yellow (Y), magenta (M), cyan (C) and black (K), for example, may also be employed. In that case, a constitution in which the carrier liquid can be supplied to the mixer of each of the plurality of image forming portions by the single carrier tank 322 may also be employed. In other words, commonality of the carrier tanks of the image forming portions for the respectively colors may preferably be achieved. This is because the toners are different in color and therefore cannot be used at the image forming portions for the respective colors on a shared basis, but the carrier liquid can be used at the image forming portions for the respective colors in the shared basis. In FIG. 10, a constitution in which the carrier liquid is capable of being supplied to four mixers by a single carrier tank was shown.

Four image forming portions (not shown) includes mixers 31Y, 31M, 31C and 31K, respectively, for supplying liquid developers different in color to developing devices as shown in FIG. 10 similarly as the image forming portion 12 shown in FIG. 1. Into the mixers 31Y, 31M, 31C and 31K, high-concentration supply agents containing the toners of the respective colors are supplied from a plurality of supply agent tanks 33Y, 33M, 33C and 33K. In the mixers 31Y, 31M, 31C and 31K, unshown solid component concentration detecting devices are provided. Into the mixers 31Y, 31M, 31C and 31K, the supply agents are appropriately supplied from the supply agent tanks 33Y, 33M, 33C and 33K depending on control of supply agent supplying pumps 42Y, 42M, 42C and 42K on the basis of predetermines of the unshown solid component concentration detecting devices.

Further, into the mixers 31Y, 31M, 31C and 31K, the carrier liquid is appropriately supplied from the carrier tank 32. However, different from the supply agent tanks 33Y, 33M, 33C and 33K provided in plurality, the carrier tank 32 is provided only one. That is, the single carrier tank 32 supplies the carrier liquid to the plurality of mixers 31Y, 31M, 31C and 31K. To the carrier tank 32, a supplying carrier tank 36 for supplying the carrier liquid for supply is provided. The single carrier tank 32 and the plurality of mixers 31Y, 31M, 31C and 31K are communicated by communicating pipes, and the communicating pipes are provided with carrier supplying pumps 41Y, 41M, 41C and 41K. The carrier supplying pumps 41Y, 41M, 41C and 41K are controlled on the basis of detection results of unshown solid component concentration detecting devices and unshown float sensors which are provided in the mixers 31Y, 31M, 31C and 31K. Incidentally, a separation and extraction device (see FIG. 2) for separating the carrier liquid and the toner from the liquid developer collected at the image forming portion for each of the colors may also be provided only one and may also be used at the image forming portions for the respective colors on the shared basis.

In the case where the single carrier tank 32 is used by the plurality of mixers 31Y, 31M, 31C and 31K on the shared basis, a calculating method of the above-described upper limit of the flow rate of the carrier supplying pump 41 has to be changed (see S3 or S4 of FIG. 4). This is because the carrier supplying pumps 41Y, 41M, 41C and 41K are provided four, whereas a carrier supplying pump for supply 51 is provided only one. In the following, the calculating method of upper limits of flow rates of the carrier supplying pumps 41Y, 41M, 41C and 41K in the case of this embodiment will be described.

In S31 of FIG. 5 described above, the carrier supply requirement for concentration adjustment is calculated. This value is tentatively referred to as Qa. On the other hand, an amount having the same value as a descending speed of the liquid developer D in the mixer 31 in a state in which the supply agent T and the carrier liquid C are not supplied is calculated as a lower limit of a supply amount to the mixer 31 from an image ratio in S53 of FIG. 6 described above. Here, that value is referred to as Qb. The sum of these Qa and Qb is a total supply requirement from which the upper limit of the flow rate of the carrier supplying pump 41 is neglected. That value is referred to as Qc. That is, Qc=Qa+Qb holds.

Those obtained by calculating this for the respective colors are referred to as QcY, QcM, QcC and QcK. When the upper limits of the flow rates of the carrier supplying pumps 41Y to 41K for the respective colors are referred to as QlimY, QlimM, QlimC and QlimK, respectively, these are calculated by formula 4 shown below. Here, only QlimY is shown, but as regards QlimM, QlimC and QlimK, QlimY and a symbol "Y" of QcY of a denominator in the formula 4 may only be required to read as "M", "C" and "K", respectively. Incidentally, Q51 max in the formula 4 is a maximum ejection flow rate of the carrier supplying pump for supply 51.

$$QlimY=QcY/(QcY+QcM+QcC+QcK)\times Q51\ \max \qquad \text{formula 4}$$

As can be understood from the formula 4, larger upper limits are provided when the supply requirements required for the carrier supplying pumps 41Y to 41K are larger, and smaller upper limits are provided when the supply requirements are smaller. Further, the sum of the upper limits of the flow rates of the four carrier supplying pumps 41Y to 41K does not exceed the maximum ejection flow rate of the carrier supplying pump for supply 51. For that reason, a situation such that the liquid amount in the carrier tank 32 continuously decreases although the carrier supplying pump for supply 51 supplies the carrier liquid for supply to the carrier tank 32 at the maximum ejection flow rate does not occur.

Incidentally, in the above-described embodiment, a constitution in which the carrier liquid for supply is directly supplied from the supply carrier tank 36 to the mixer 36 may also be employed. Further, a constitution in which the supply carrier tank 36 exclusively for supplying the carrier liquid for supply is not provided and the carrier liquid for supply is directly supplied to the carrier tank 32 and the mixer 31 may also be employed.

INDUSTRIAL APPLICABILITY

According to the present invention, there is provided an image forming apparatus which uses the liquid developer and which is capable of shortening a time required for concentration adjustment of the liquid developer than that in the conventional constitution.

EXPLANATION OF SYMBOLS

12 . . . image forming portion, 31 . . . supplying device (mixer), 32A . . . carrier liquid supplying device, 33*a* . . . supply agent supplying device, 36A . . . supplying device, 100 . . . image forming apparatus, 200 control means (controller), 310 . . . liquid amount detecting means (first float sensor), 311 . . . concentration detecting means (solid component concentration detecting device), 320 . . . carrier liquid amount detecting means (second float sensor)

The invention claimed is:

1. An image forming apparatus comprising:

an image bearing member;

a developing portion for developing an electrostatic image, formed on said image bearing member, with a liquid developer containing toner and a carrier liquid;

a supplying device, accommodating the liquid developer, for supplying the liquid developer to said developing portion;

a liquid amount detector for detecting a liquid amount of the liquid developer in said supplying device;

a concentration detector for detecting a concentration of toner relative to the liquid developer in said supplying device;

a carrier liquid supplying device for supplying the carrier liquid to said supplying device;

a toner supplying device for supplying the toner to said supplying device; and a controller for controlling an amount of the carrier liquid supplied from said carrier liquid supplying device to said supplying device and an amount of the toner supplied from said toner supplying device to said supplying device so that the liquid developer in which the concentration of the toner relative to the liquid is a set concentration on the basis of a detection result of said concentration detector is in a predetermined amount in said supplying device on the basis of a detection result of said liquid amount detector, wherein said controller is capable of executing, in a case that the concentration of the liquid developer detected by said concentration detector is higher than the set concentration, a carrier liquid supplying mode in which a first supply amount of the carrier liquid is supplied from said carrier liquid supplying device to provide the set concentration of the toner in said supplying device, and in which the carrier liquid is supplied into said supplying device.

2. An image forming apparatus according to claim 1, wherein in a case that the carrier liquid in a second supply amount is supplied to said supplying device in addition to the first supply amount, the toner in an amount corresponding to the second supply amount of the carrier liquid is supplied from said toner supplying device to said supplying device so that the concentration of the toner is the set concentration.

3. An image forming apparatus according to claim 2, wherein when the carrier liquid supplying mode is executed during an image forming operation, in a case that the first supply flow rate is less than a consumption amount per unit time of the liquid developer consumed with image formation, a difference between the consumption amount of the liquid developer and the first supply flow rate is set at a third supply flow rate, and not only the carrier liquid is supplied to said carrier liquid supplying device in an amount in which the first supply flow rate and the third supply flow rate are added but also a supply agent is supplied to said supply agent supplying device in an amount depending on the third supply flow rate.

4. An image forming apparatus according to claim 3, wherein said controller acquires the consumption amount of the liquid developer on the basis of an image ratio of an image to be formed.

5. An image forming apparatus according to claim 3, wherein said controller sets the third supply flow rate at 0 in a case that the first supply flow rate is not less than the consumption amount per unit time of the liquid developer consumed with the image formation.

6. An image forming apparatus according to claim 1, wherein said controller acquires the first supply flow rate on the basis of an accumulated value of a difference between a concentration of the liquid developer detected by said concentration detector and the set concentration.

7. An image forming apparatus according to claim 6, wherein said controller does not accumulate the difference in a case that the first supply flow rate exceeds a maximum ejection flow rate of said carrier liquid supplying device.

8. An image forming apparatus according to claim 1, wherein in a case that a developer amount in said supplying device does not reach a set amount in a case that the carrier liquid in the first supply amount is supplied on the basis of said liquid amount detector, a fourth supply amount for causing the developer amount to reach the set amount is set, and the carrier liquid in the fourth supply amount is supplied from said carrier liquid supplying device to said supplying device and the toner in an amount corresponding to the fourth supply amount of the carrier liquid is supplied from said toner supplying device to said supplying device so that the concentration of the toner in said supplying device is the set concentration.

9. An image forming apparatus according to claim 1, comprising a cleaning portion for collecting the liquid developer remaining on said image bearing member and a separating device for separating the liquid developer collected by said cleaning portion into the toner and the carrier, wherein the carrier liquid separated from the liquid developer by said separating device is supplied to said carrier liquid supplying device.

10. An image forming apparatus according to claim 9, comprising a collecting portion, mountable in and dismountable from said image forming apparatus, for collecting the toner separated from the liquid developer by said separating device.

11. An image forming apparatus according to claim 9, comprising a carrier liquid container including the carrier liquid to be supplied to said carrier liquid supplying device and mountable in and dismountable from said image forming apparatus, wherein a path along which the carrier is supplied from said carrier liquid container to said carrier liquid supplying device is different from a path along which the carrier is supplied from said separating device to said carrier liquid supplying device.

12. An image forming apparatus according to claim 1, comprising a toner container including the toner to be supplied to said toner supplying device and mountable in and dismountable from said image forming apparatus.

* * * * *